US008336479B2

(12) United States Patent
Vosburgh et al.

(10) Patent No.: US 8,336,479 B2
(45) Date of Patent: Dec. 25, 2012

(54) SYSTEMS AND METHODS OF USE FOR SUBMERGED DEPLOYMENT OF OBJECTS

(75) Inventors: Frederick Vosburgh, Durham, NC (US); Charles A. Pell, Durham, NC (US)

(73) Assignee: iRobot Corporation, Bedford, MA (US)

( * ) Notice: Subject to any disclaimer, the term of this patent is extended or adjusted under 35 U.S.C. 154(b) by 728 days.

(21) Appl. No.: 12/355,966

(22) Filed: Jan. 19, 2009

(65) Prior Publication Data

US 2012/0298029 A1 Nov. 29, 2012

Related U.S. Application Data

(60) Provisional application No. 61/022,644, filed on Jan. 22, 2008.

(51) Int. Cl.
*B63G 8/41* (2006.01)

(52) U.S. Cl. ..... 114/322; 114/324

(58) Field of Classification Search ..... 114/322–325, 114/253, 254, 238

See application file for complete search history.

(56) References Cited

U.S. PATENT DOCUMENTS

| | | | | |
|---|---|---|---|---|
| 2,568,210 | A * | 9/1951 | Whitney | 294/100 |
| 3,561,387 | A * | 2/1971 | Kumm et al. | 114/322 |
| 6,179,683 | B1 | 1/2001 | Pell et al. | |
| 6,190,265 | B1 * | 2/2001 | Schmitt | 473/286 |
| 6,250,585 | B1 | 6/2001 | Pell | |
| 6,378,801 | B1 | 4/2002 | Pell et al. | |
| 6,974,356 | B2 | 12/2005 | Hobson et al. | |
| 7,495,999 | B2 | 2/2009 | Kemp et al. | |
| 7,798,086 | B2 * | 9/2010 | Ruggaber | 114/238 |

* cited by examiner

*Primary Examiner* — Stephen Avila
(74) *Attorney, Agent, or Firm* — Myers Bigel Sibley & Sajovec, PA

(57) ABSTRACT

A submersible object management (SOM) system for releasing and/or recovering a plurality of submersible objects within a body of liquid includes a hold and a deployment system. The hold is configured to store the plurality of submersible objects. The deployment system is selectively operable to controllably release at least one of the plurality of submersible objects from the hold into submersion in the body of liquid and/or selectively operable to controllably direct at least one of the plurality of submersible objects into the hold from submersion in the body of liquid. The deployment system includes a guide that is selectively extendable to direct the at least one submersible object, the guide including a plurality of extendable guide members configured to engage the at least one submersible object.

29 Claims, 7 Drawing Sheets

SYSTEMS AND METHODS OF USE FOR SUBMERGED DEPLOYMENT OF OBJECTS

RELATED APPLICATION(S)

The present application claims the benefit of priority from U.S. Provisional Patent Application No. 61/022,644, filed Jan. 22, 2008, the disclosure of which is incorporated herein by reference in its entirety.

STATEMENT OF GOVERNMENT SUPPORT

This invention was made with support under Small Business Innovation Research (SBIR) Contract No. W31P4Q-06-C-0105 awarded by the Defense Advanced Research Projects Agency (DARPA) and administered by Redstone Arsenal. The Government has certain rights in the invention.

FIELD OF THE INVENTION

The present invention relates to submerged objects and, more particularly, to deployment of submerged objects.

BACKGROUND OF THE INVENTION

In some applications, it is necessary or desirable to deploy a plurality of submerged objects, such as sensors or unmanned underwater vehicles (UUVs). Provision must be made for introducing such objects into and/or recovering the objects from the submersion environment.

SUMMARY OF THE INVENTION

According to embodiments of the present invention, a submersible object management (SOMI) system for releasing and/or recovering a plurality of submersible objects within a body of liquid includes a hold and a deployment system. The hold is configured to store the plurality of submersible objects. The deployment system is selectively operable to controllably release at least one of the plurality of submersible objects from the hold into submersion in the body of liquid and/or selectively operable to controllably direct at least one of the plurality of submersible objects into the hold from submersion in the body of liquid. The deployment system includes a guide that is selectively extendable to direct the at least one submersible object, the guide including a plurality of extendable guide members configured to engage the at least one submersible object.

In some embodiments, the guide members are elongated tines.

According to some embodiments, the deployment system is selectively operable to controllably release exactly one of the plurality of submersible objects at a time from the hold into submersion in the body of liquid outside the hold.

According to some embodiments, the deployment system is selectively operable to controllably direct exactly one of the plurality of submersible objects at a time into the hold from submersion in the body of liquid outside the hold.

In some embodiments, the submersible objects are unmanned underwater vehicles (UUVs). In some embodiments, the submersible objects are sensors.

The SOM system may include a portal between the hold and the body of liquid and configured to receive one of the submersible objects therethrough, wherein the guide members are selectively extendable to direct the received submersible object from the body of liquid and through the portal.

The SOM system may include a portal between the hold and the body of liquid and configured to receive one of the submersible objects therethrough, wherein the guide members are selectively extendable to guide release of the submersible object through the portal into the body of liquid.

According to some embodiments, the SOM system includes a portal between the hold and the body of liquid and configured to receive one of the submersible objects therethrough. The guide members are selectively extendable from a closed position to an open position. When in the closed position, the guide members prevent passage of the submersible object through the portal. When in the open position, the guide members permit passage of the submersible object through the portal.

In some embodiments, the deployment system includes a dispenser. The dispenser is configured to convey at least one of the submersible objects between the hold and a staging location. The dispenser may include: a revolver member including a plurality of beds each configured to hold a respective one of the submersible objects; and a drive mechanism to rotate the revolver member to selectively position each of the beds adjacent the staging location. In some embodiments, the dispenser includes: a hopper configured to hold a stack of the submersible objects; and a singulator configured to receive and controllably convey at least one of the submersible objects from the hopper to the staging location.

According to some embodiments, the SOM system includes a platform and a connector. The hold and the connector are mounted on the platform. The connector is configured to couple with at least one of the submersible objects to transfer power and/or communicating signals between the submersible object and the platform via the connector.

In some embodiments, the SOM system includes a mobile platform, wherein the hold and the deployment system are mounted on the mobile platform.

In some embodiments, the mobile platform is an unmanned underwater vehicle (UUV).

In some embodiments, the SOM system includes the plurality of submersible objects.

According to method embodiments of the present invention, a method for managing submersible objects in a body of liquid includes providing a submersible object management (SOM) system in a body of liquid, the SOM system including: a hold for storing a plurality of submersible objects; and a deployment system including a guide, the guide including a plurality of selectively extendible guide members. The method further includes selectively operating the deployment system to controllably release at least one of the plurality of submersible objects from the hold into submersion in the body of liquid and/or selectively operable to controllably direct at least one of the plurality of submersible objects into the hold from submersion in the body of liquid, including selectively extending the guide members of a guide to engage and direct the at least one submersible object.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE PRESENT INVENTION

Figure 1:
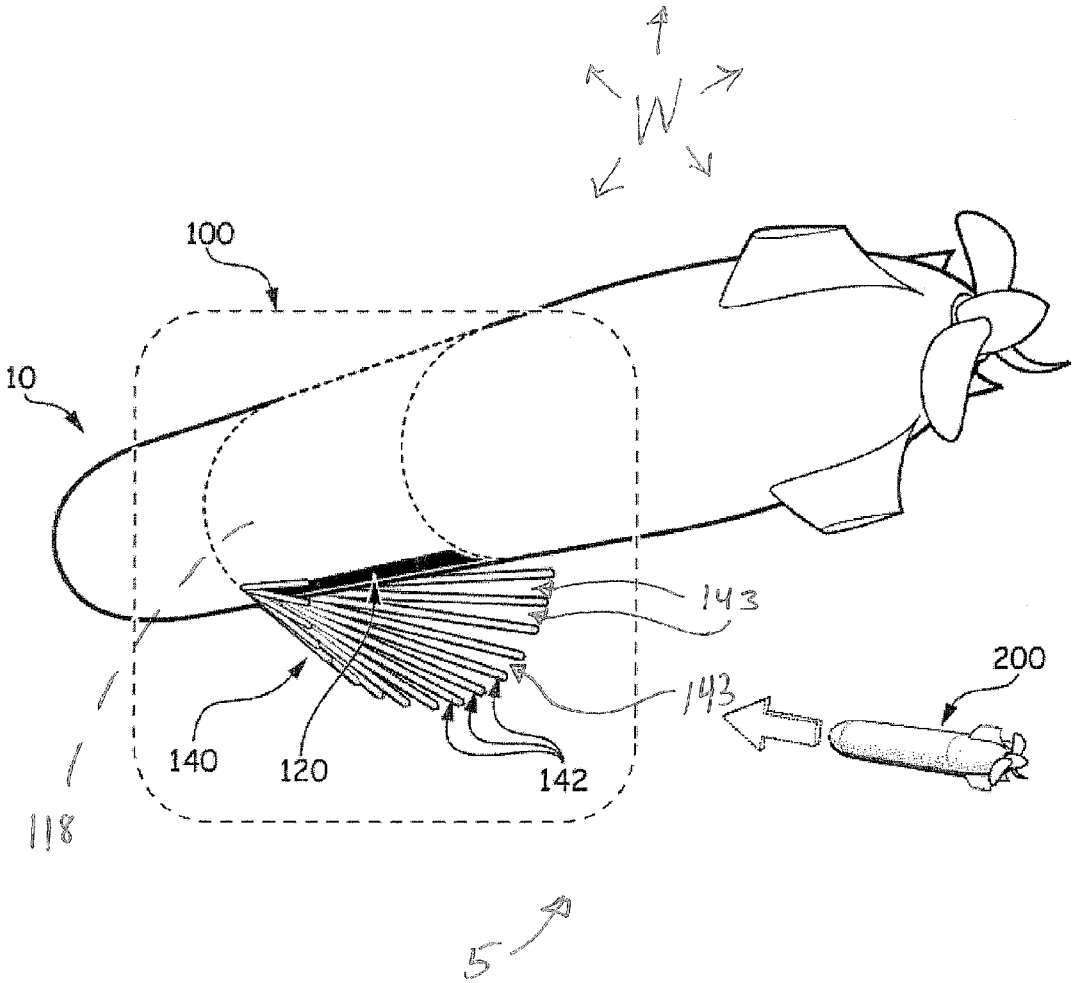
FIG. 1 is a schematic perspective view of a submersible object management (SOM) system according to embodiments of the present invention, wherein guide tines forming a part thereof are extended.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

With reference to FIGS. 1-5, a submersible object management (SOM) system according to embodiments of the present invention is shown therein. The SOM system 5 includes a platform 10, a deployment system 100 (which may also be referred to as a "launch/recover assembly"), and one or more deployable, submersible objects 200 (which may be referred to herein a "submersible" or "submersibles" 200). The deployment system 100 is configured to deploy the submersibles 200. The deployment system 100 can be used to launch the submersibles 200 into a body of liquid W (e.g., a body of water) from the platform 10 and/or to recover the submersibles 200 onto the platform 10 from the body of liquid W.

Referring to FIG. 1, the platform 10 can be any type that can operate in the body of liquid W (e.g., water). For example, the platform 10 may be an unmanned undersea vehicle, manned submersible, surface vehicle, tow body, buoy, or aircraft, although other platforms can be used.

Examples of submersibles 200 can include a vehicle, a sensor, a beacon, a neutralizer, a payload, an energy cache, or another object. According to some embodiments, the submersibles 200 are sensor devices. According to some embodiments, the submersibles 200 are unmanned underwater vehicles (UUVs) and may be autonomous underwater vehicles (AUVs). Suitable AUVs may include, for example, AUVs as disclosed in U.S. Patent Application Publication No. 2008/0239874 (Kemp et al.), The deployment system 100 is configured to selectively and controllably deploy (which may include launch or recovery) a submersible 200 with respect to the platform 10. In some embodiments, the deployment system 100 comprises a hold 118, a portal or doorway 120 and a guide 140. The hold 118 is configured to hold a plurality of the submersibles 200. The guide 140 can be any device that can deploy, release, guide, direct, position, shield or otherwise aid a submersible 200 during deployment. In some cases, the guide 140 includes a set of guide members or structures 142, such as elongated tines (and referred to herein as "the tines 142"), which are extendable and which can engage and provide a passage for the submersible 200.

Figure 2A:
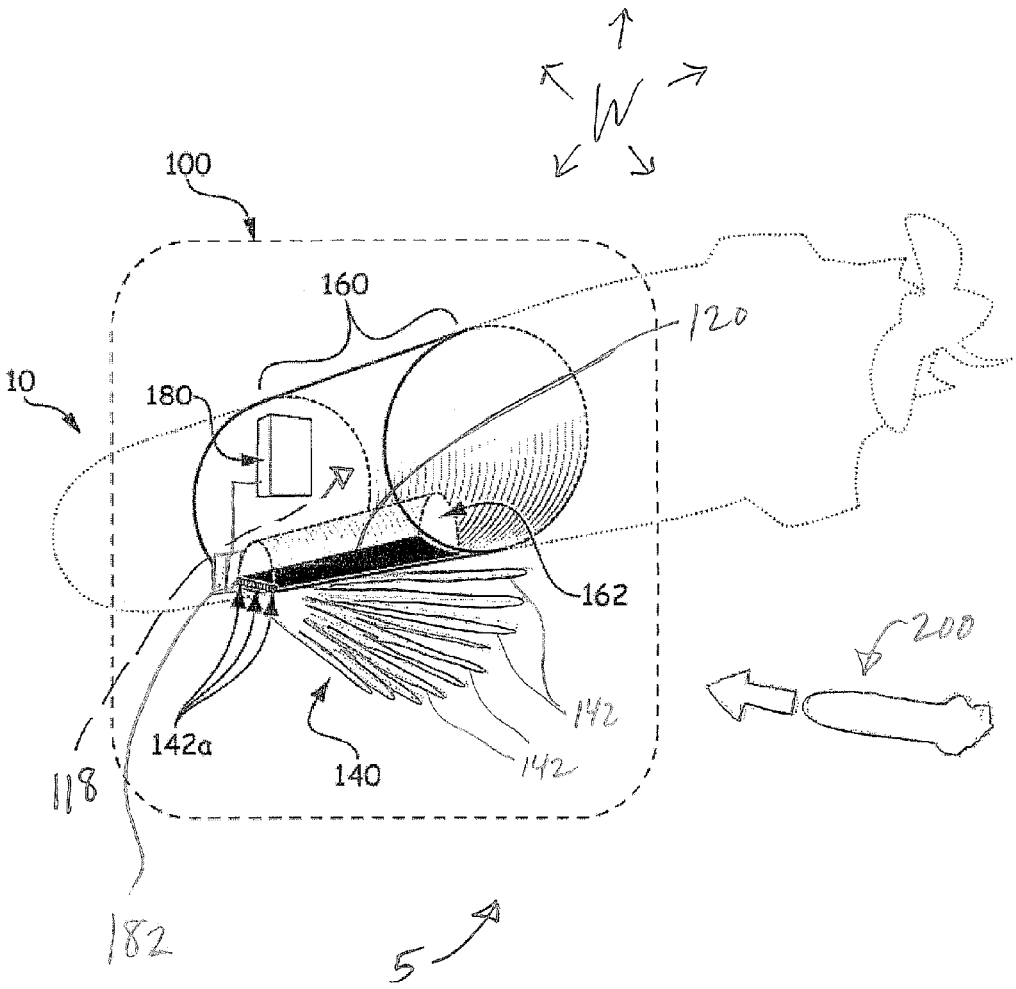
FIG. 2A is a schematic perspective view of the SOM system of FIG. 1 wherein a dispenser and a controller thereof are highlighted and wherein the guide tines are extended into an open position.

Referring to FIG. 2A, in some cases the deployment system 100 includes a dispenser 160 and a controller 180. The dispenser 160 can be any device that can position a submersible 200 with respect to the guide 140. In some cases, the dispenser 160 includes a device for holding a submersible 200 before launching or after recovering. The controller 180 can be of any type that can suitably control at least one of the platform 10, a submersible 200, the deployment system 100, the dispenser 160, the guide 140, and the tines 142.

Each tine 142 can be of any type having desirable size, shape, and mechanical properties. In some cases, the tine shape is at least one of: drag affecting and lift affecting. According to some embodiments, at least some of the tines 142 have a length to width ratio of at least 5:1 and, according to some embodiments, at least 20:1. In other embodiments, the guide members can be otherwise shaped (e.g., elongated plates).

In some cases, the guide 140 includes at least one of an attachment or attachments 142*a*, an interconnect and a stabilizer connected with the tines 142. An attachment 142*a* can comprise any type of coupling that can mount a tine 142 (e.g., a rotating, sliding, or pivot type (hereafter "pivot") attachment). An interconnect can be any type of structure (e.g., wire) that can constrain spaces between tines 142. A stabilizer can be any type structure (e.g., hinge or stave) that can constrain spatial relationship between the guide 140 and the platform 10.

Figure 2B:
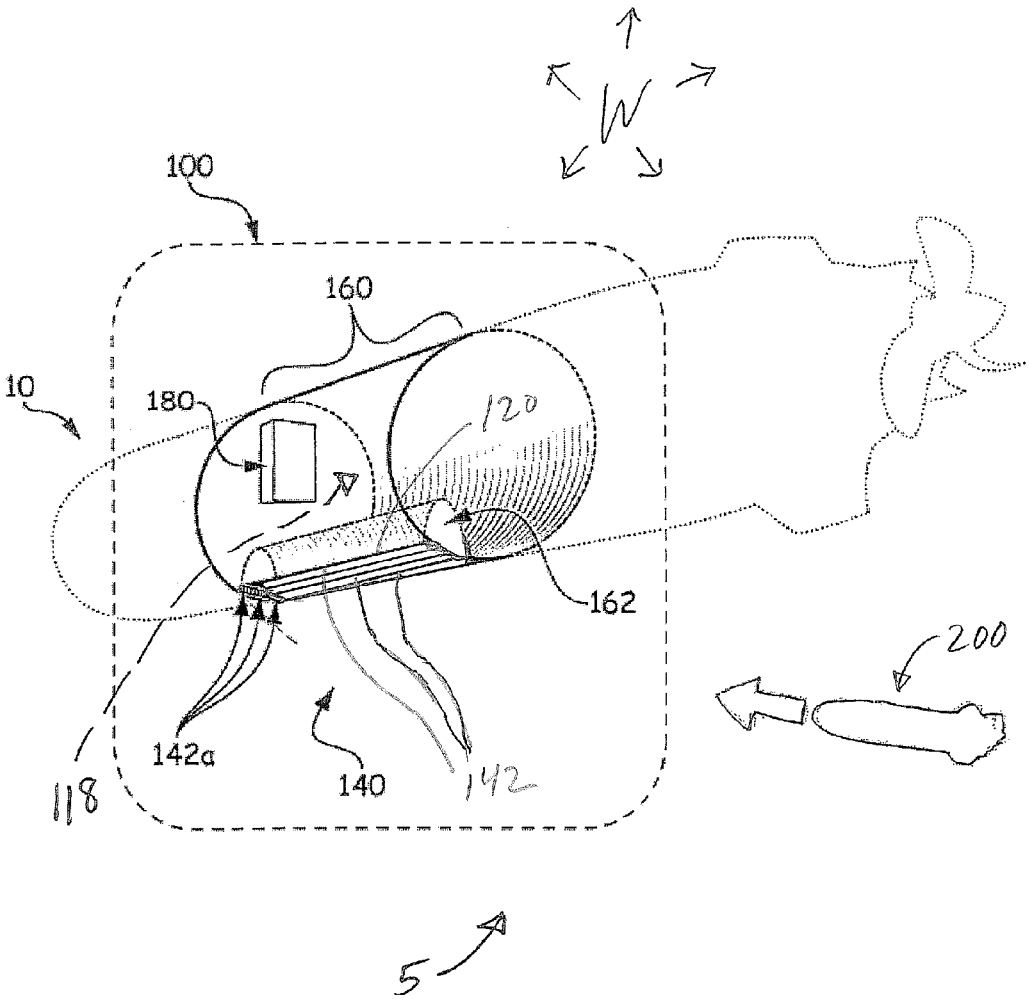
FIG. 2B is a schematic perspective view of the SOM system of FIG. 1 wherein the dispenser and the controller thereof are highlighted and wherein the guide tines are retracted into a closed position.

The tines 142 can be selectively moved, transitioned or displaced between an open or extended position (as shown in FIG. 2A) and a closed or retracted position (as shown in FIG. 2B) by the controller 180 and an associated actuator 182 (FIG. 2A; e.g., an electric motor, pneumatic force actuator, hydraulic force actuator, electromagnet or the like), for example. When in the open position, the tines 142 permit the passage of a submersible 200 through the doorway 120. When in the closed position, the tines 142 prevent the passage of a submersible 200 through the doorway 120. In the open position, the tines 142 define gaps or passageways 143 (FIG. 1) between adjacent ones of the tines 142. In the closed position, the tines 142 may be closely adjacent or overlapping one another to form a substantially continuous barrier without openings therethrough. When in the open position, the tines 142 may define a basket. According to some embodiments, the basket is generally conical or frusto-conical in shape as shown in FIG. 1, for example.

Figure 3:
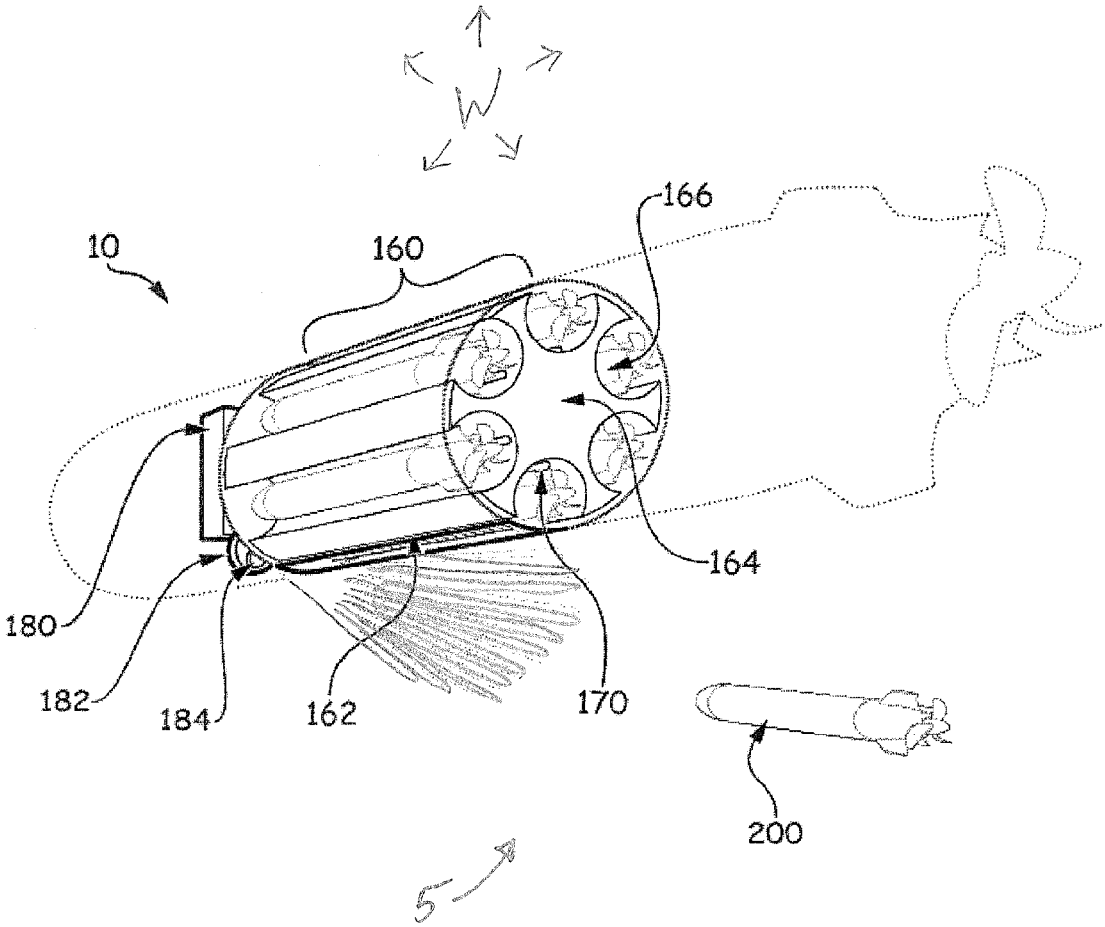
FIG. 3 is a schematic perspective view of the SOM system of FIG. 1 illustrating a dispenser according to a first embodiment in further detail.

Referring to FIG. 3, an illustrative dispenser 160 is shown therein and includes a revolver 164 of any type that can move one or more submersibles 200 into a deployment position 162. In some cases, the revolver 164 comprises one or more beds 166, which can be any portion or structure, such as a slots or cavities of the revolver 164 for locating a submersible 200.

In some cases, the dispenser 160 further comprises a drive 182 which can be a type of device (e.g., stepper motor, spring, ratchet mechanism, etc.) that can move a bed 166 into the deployment position 162 under the control of the controller 180, for example. In some cases, the deployment system 100 includes an indexing sensor 182 of any type that can determine rotational position of the revolver 164, such as an encoder, proximity type detector, counter, or data reader. In some cases, the indexing sensor 182 includes a component of the controller 180. In some cases, the deployment system 100 includes a push-rod 170 that exerts a force or moment on a portion of a submersible 200 during deployment.

Figure 4:
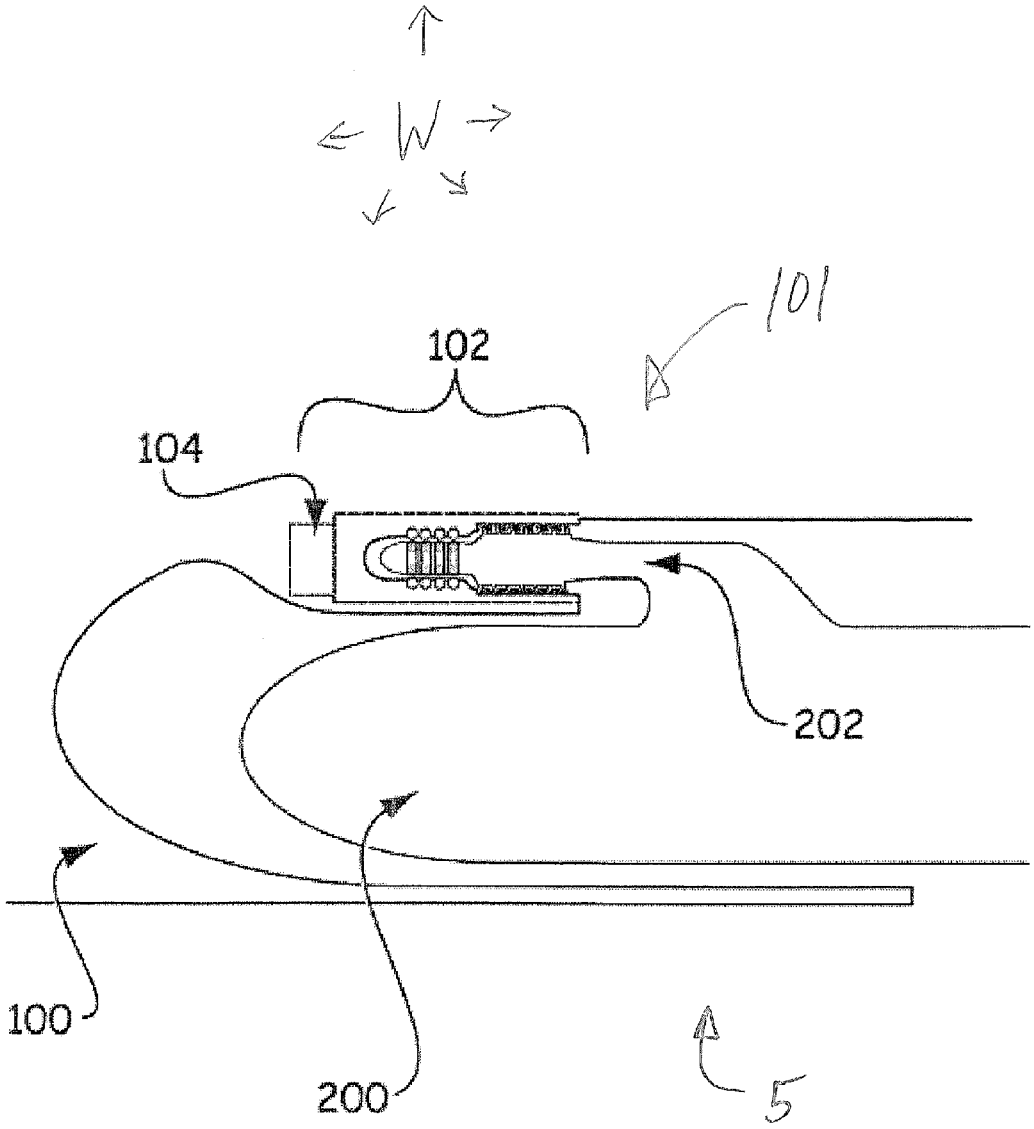
FIG. 4 is an enlarged, schematic cross-sectional view of the SOM system of FIG. 1 illustrating a connector system thereof.

Referring to FIG. 4, the SOM system 5 may include a connector system 101 including a first connector 102 of any type (e.g., a female or receptacle type). In some cases, the submersible 200 further comprises an illustrative second connector 202 (e.g., a male or probe type). In some cases, the first connector type and the second connector type can comprise any mechanical type (e.g., screw, magnetic, pressure), and can comprise compatible constructions.

The illustrated example comprises a threaded male probe and threaded female receptacle having complementary shapes. In some cases, the first connector 102 further comprises a mating drive 104 that can be of any type that can provide a mating force or torque, such as to twist the first connector 102 and second connector 104 together. In some cases, the first connector 102 or the second connector 202 comprises a type which can transmit at least one of power and data by electrical, optical, acoustic, radio, or magnetic means.

Figure 5:
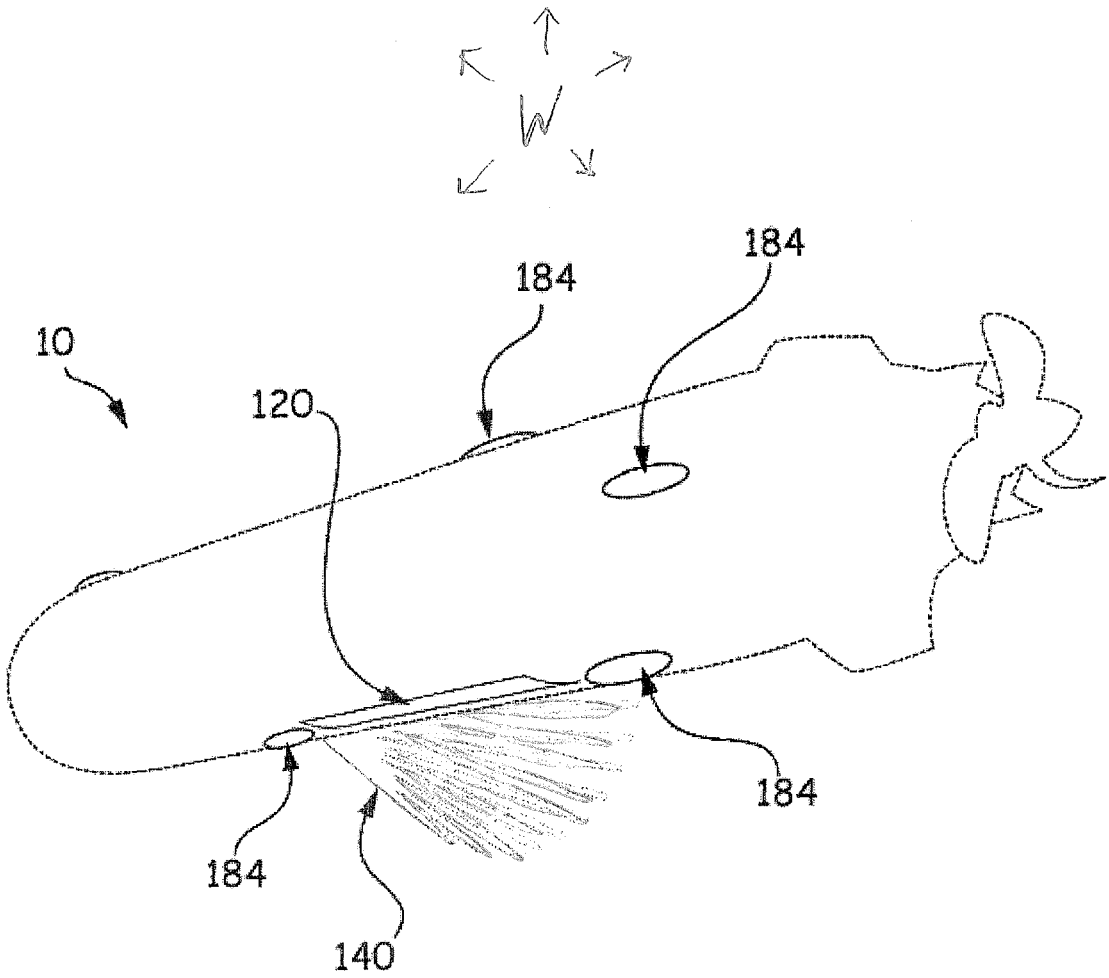
FIG. 5 is a schematic cross-sectional view of the SOM system of FIG. 1 illustrating a signal device system thereof.

Referring to FIG. 5, in some cases, the SOM system 5 includes one or more signal devices 184, which can comprise any type that can send or receive a signal and which can be mounted on the platform 10 or deployment system 100. In some cases, at least one signal device 184 is mounted adjacent the guide 140 or doorway 120.

Figure 6:
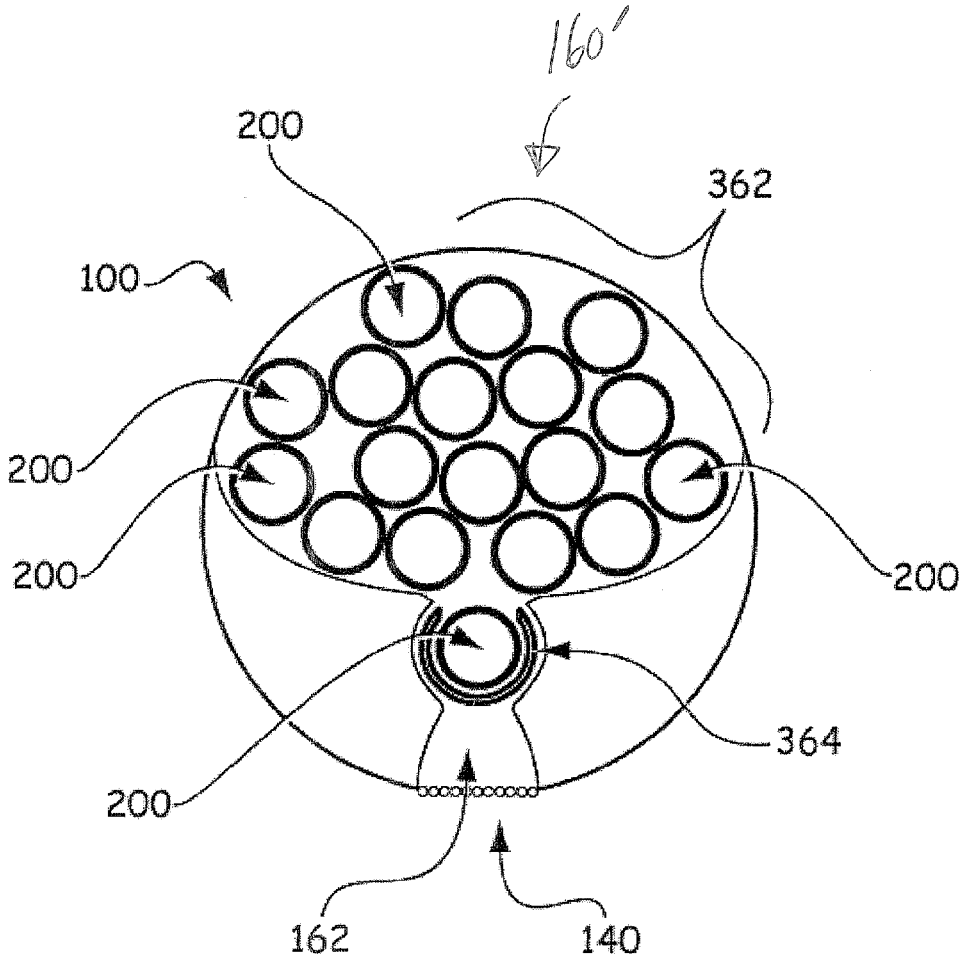
FIG. 6 is a schematic cross-sectional view of the SOM system of FIG. 1 illustrating a dispenser according to a second embodiment in further detail.

Referring to FIG. 6, an alternative dispenser 160' according to further embodiments of the invention is shown therein. The dispenser 160' includes a hopper or stowage 362, defined as a region of the platform 10 or dispenser 160' other than in the deployment position 162 in which a submersible 200 can be held (e.g., during transit) and a stager or singulator 364, which can be any type of device that can move a submersible 200 between the deployment position 162 and the stowage 362. The submersible 200 can be stacked in the stowage 362 awaiting launch. One illustrative type of singulator 364 includes a cylinder type having a submersible opening and which can rotate between the deployment location 162 and the stowage 362.

In some cases, the signal device type comprises at least one of: detector and emitter. In some cases, the signal device type comprises at least one of: communicating, locating, proximity detecting, tracking, and guiding. In some cases, signal device type comprises at least one of: acoustic, optical, magnetic, electrical, and mechanical. In some cases, the emitter type further comprises at least one of: tonal, multi-tonal, spread spectrum, narrow band, wide band, frequency modulated, and amplitude modulated.

The SOM system 5 can be used to deploy a submersible 200. Methods of use in accordance with some embodiments of the invention include at least one of launching, guiding, shielding, recovering, data transferring, navigation aiding, commanding, controlling, and communicating. In some cases, the SOM system 5 is used for least one of: intelligence gathering, surveillance conducting, reconnaissance conducting, mapping, navigating, navigation aiding, signal detecting, signal providing, locating, classifying, imaging, identifying, payload transporting, and object neutralizing. The SOM system 5 may be used for other uses as well.

In some cases, launching further comprises at least one of: staging, positioning, energy transferring, information downloading, and releasing. In some cases, staging comprises moving a submersible 200 to a deployment location. In some cases, staging comprises moving at least one of: the deployment system 100, the dispenser 160, 160', the bed 166, bed and a submersible 200.

In some cases, energy transferring comprises energy transfer from the platform 10 to a submersible 200 prior to deploying. In some cases, data providing comprises providing navigational or operational data from the platform to the submersible. In some cases, data providing comprises providing of operational status data from the submersible to the platform. In some cases, data transferring comprises transferring data from a submersible to the system before, during, and/or after deploying the submersible.

An example of intelligence gathering comprises using a detector to detect signals or other data which can be transferred to the platform 10 or a user. An example of mapping comprises sending and receiving sonar signals which can be used to form an image of objects in the water or on the substratum. An example of surveying comprises determining the bathymetry of an area. An example of reconnaissance conducting comprises searching for a desirable object. An example of detecting includes determining the presence of an object. An example of classifying includes classifying a detected object as mine-like. An example of identifying includes determining a mine-like object is a mine. An example of payload delivering includes delivering a neutralizing charge proximate a mine. Another example of payload delivering includes placing one or more signal devices in an operational location, e.g., for persistent surveillance or navigation aiding.

According to some embodiments, submersible navigating (e.g., for recovery) is conducted with respect to signals from one or more signal devices to determine range and bearing from the submersible to the platform. Such determining may be conducted by any method, such as beam forming or image forming sonar, Doppler direction finder, magnetic induction sensor, proximity sensor, or other type of navigational sensor.

The tines 142 engage and guide each submersible 200 as the submersible 200 is directed into the hold 118 through the doorway 120 (for recovery) or out of the hold 118 through the doorway 120 (for launch). In some cases, the tines 142 are retracted with respect to the platform 10 into the closed position (FIG. 2B) except during or in preparation for launch or recovery of a submersible 200. In some cases, the tines 142 are positioned in a hydrodynamic manner. In some cases, navigational control of the platform is adjusted to compensate for hydrodynamic effects of extension or retraction of tines as a means of providing desirable platform control or movement. The tines 142 can permit flow of the submersion liquid W through the gaps 143 therebetween.

For launch, the system can stage a submersible 200 for launch and extend the tines 142 from the closed position to the open position. In some cases, a ratchet rotates or indexes a bed 166 into position and a pivot pivots one or more tines 142 with respect to the attachment point 142*a* until the tine or tines 142 are desirably extended. Once the tines are extended, a submersible 200 is released. For this, the submersible 200 can be turned on. The submersible 200 can be disconnected from the dispenser 160 and, optionally, mechanically pushed through the doorway 120 (e.g., by a tilt-rod at the stern (e.g., the tilt rod 170)). The submersible 200 can then navigate in reverse through and out of the guide 140 and then commence operation. In some cases, the submersible 200 is self-propelled. In some cases, the submersible is not self-propelled. Launch then comprises release from the bed 166 into the guide 140, where water flow and, optionally, submersible buoyancy or shape cause the submersible to exit the guide 140.

In some cases, the SOM system 5 then prepares to launch a next submersible 200, which can include staging as outlined above. In some cases, the SOM system 5 also moves a submersible 200 from stowage to a position with respect to the ratchet and activates the ratchet, or the system rotates a revolver 164 to advance the next submersible into location for launch.

In some cases, the tines 142 are retracted between launches and the guidance and control of the platform 10 is adjusted accordingly. In some embodiments, the tines 142 are retracted into and retained in the closed position after the final submersible 200 is released in a given launch session.

According to some embodiments, a method of recovering a submersible 200 comprises extending the tines 142 from the closed position to the open position and guiding or providing navigation aiding signals to a submersible closing with the platform 10, sensing the submersible at a desirable location with respect to the guide 140, and retracting the tines 142 to engage and lift the submersible 200 into the deployment location 162 or dispenser 160, 160'. In some cases, recovery comprises the platform 10 sending navigational data or commands to the submersible 200. In some cases, a submersible 200 is commanded to shutdown once in the deployment location 162. In some cases, a connection is made by the connector system 101 for transfer of power and data between the submersible 200 and the deployment system 100 or platform 10. In some cases, the revolver 164 is rotated to move a bed 166 holding a recovered submersible 200 and positioning an empty bed 166 for recovery of a next submersible 200. In some cases, the tines 142 remain retracted (i.e., closed) until the next desirable time or location of desirable recovery.

In some cases, launching and recovering of a plurality of submersibles 200 are interspersed. For example, one submersible 200 can be launched, followed by recovery of another, thereafter followed by launch of yet another. In some cases, any other number or sequence of interspersed launches and recoveries can be executed. In some embodiments, the tines 142 are closed between recoveries and launches and opened during and just prior to each recovery and launch.

According to some embodiments, the deployment system 100 recovers the submersible 200 directly from full submersion in the body of liquid W outside the hold 118 while the platform 10 is also fully submerged in the body of liquid W. According to some embodiments, the deployment system 100 launches the submersible 200 directly into full submersion in the body of liquid W outside the hold 118 while the platform 10 is fully submerged in the body of liquid W.

The hold 118, including the beds 116 and the stowage 362, may be flooded with the liquid W so that the submersibles 200 remain partially or fully submerged in the liquid W when contained in the hold 118.

The guide 140 as disclosed herein can provide certain advantages and benefits in executing deployment of the submersibles 200 from or into the platform 10. In some cases, the platform 10 is in motion so that a flow of the liquid W (e.g., water) with respect to the platform 10 is present. When extended, the tines 142 can advantageously manage the liquid (water) flow with respect to the platform 10 and the submersible 200. In particular, the tines 142 can breakup, reduce, redirect or dissipate turbulence in the flow from the platform 10, thereby smoothing the entry and exit of the submersible 200 with respect to the platform 10.

While use of the system is described for submersible deployment, systems according to embodiments of the invention may be employed for other uses.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

We claim:

1. A submersible object management (SOM) system for releasing and/or recovering a plurality of submersible objects within a body of liquid, the SOM system comprising:

a hold for storing the plurality of submersible objects; and a deployment system selectively operable to controllably release at least one of the plurality of submersible objects from the hold into submersion in the body of liquid and/or selectively operable to controllably direct at least one of the plurality of submersible objects into the hold from submersion in the body of liquid, wherein the deployment system includes:

a guide that is selectively extendable to direct the at least one submersible object, the guide including a plurality of extendable guide members configured to engage the at least one submersible object; and a dispenser being configured to convey at least one of the submersible objects between the hold and a staging location, wherein the dispenser includes:

a revolver member including a plurality of beds each configured to hold a respective one of the submersible objects; and a drive mechanism to rotate the revolver member to selectively position each of the beds adjacent the staging location.

2. The SOM system of claim 1 wherein the guide members are elongated tines.

3. The SOM system of claim 1 wherein the deployment system is selectively operable to controllably release exactly one of the plurality of submersible objects at a time from the hold into submersion in the body of liquid outside the hold.

4. The SOM system of claim 1 wherein the deployment system is selectively operable to controllably direct exactly one of the plurality of submersible objects at a time into the hold from submersion in the body of liquid outside the hold.

5. The SOM system of claim 1 wherein the submersible objects are unmanned underwater vehicles (UUVs).

6. The SOM system of claim 1 wherein the submersible objects are sensors.

7. The SOM system of claim 1 including a portal between the hold and the body of liquid and configured to receive one of the submersible objects therethrough, wherein the guide members are selectively extendable to direct the received submersible object from the body of liquid and through the portal.

8. The SOM system of claim 1 including a portal between the hold and the body of liquid and configured to receive one of the submersible objects therethrough, wherein the guide members are selectively extendable to guide release of the submersible object through the portal into the body of liquid.

9. The SOM system of claim 1 including a portal between the hold and the body of liquid and configured to receive one of the submersible objects therethrough, wherein:

the guide members are selectively extendable from a closed position to an open position;

when in the closed position, the guide members prevent passage of the submersible object through the portal; and when in the open position, the guide members permit passage of the submersible object through the portal.

10. The SOM system of claim 1 including a platform and a connector, wherein:

the hold and the connector are mounted on the platform; and the connector is configured to couple with at least one of the submersible objects to transfer power and/or communicating signals between the submersible object and the platform via the connector.

11. The SOM system of claim 1 including is a mobile platform, wherein the hold and the deployment system are mounted on the mobile platform.

12. The SOM system of claim 11 wherein the mobile platform is an unmanned underwater vehicle (UUV).

13. The SOM system of claim 1 including the plurality of submersible objects.

14. A submersible object management (SOM) system for releasing and/or recovering a plurality of submersible objects within a body of liquid, the SOM system comprising:

a platform;

a hold for storing the plurality of submersible objects; and a deployment system selectively operable to controllably release at least one of the plurality of submersible objects from the hold into submersion in the body of liquid and/or selectively operable to controllably direct at least one of the plurality of submersible objects into the hold from submersion in the body of liquid, wherein the deployment system includes:

a guide including a plurality of extendable guide members that are configured and selectively extendable to engage and direct the at least one submersible object;

wherein, when the guide members are extended, the guide members are configured to manage a flow of the liquid with respect to the platform and the at least one submersible object;

wherein the deployment system includes a dispenser, the dispenser being configured to convey at least one of the submersible objects between the hold and a staging location; and wherein the dispenser includes:

a revolver member including a plurality of beds each configured to hold a respective one of the submersible objects; and a drive mechanism to rotate the revolver member to selectively position each of the beds adjacent the staging location.

15. A submersible object management (SOM) system for releasing and/or recovering a plurality of submersible objects within a body of liquid, the SOM system comprising:

a platform;

a hold for storing the plurality of submersible objects; and a deployment system selectively operable to controllably release at least one of the plurality of submersible objects from the hold into submersion in the body of liquid and/or selectively operable to controllably direct at least one of the plurality of submersible objects into the hold from submersion in the body of liquid, wherein the deployment system includes:

a guide including a plurality of extendable guide members that are configured and selectively extendable to engage and direct the at least one submersible object;

wherein, when the guide members are extended, the guide members are configured to manage a flow of the liquid with respect to the platform and the at least one submersible object;

wherein the deployment system includes a dispenser, the dispenser being configured to convey at least one of the submersible objects between the hold and a staging location; and wherein the dispenser includes:

a hopper configured to hold a stack of the submersible objects; and a singulator configured to receive and controllably convey at least one of the submersible objects from the hopper to the staging location.

16. A method for managing submersible objects in a body of liquid, the method comprising:

providing a submersible object management (SOM) system in a body of liquid, the SOM system including:

a platform;

a hold for storing a plurality of submersible objects; and a deployment system including a guide, the guide including a plurality of selectively extendable guide members;

wherein the deployment system includes a dispenser, the dispenser being configured to convey at least one of the submersible objects between the hold and a staging location; and wherein the dispenser includes at least one of a revolver dispenser and a singulator dispenser, wherein:

the revolver dispenser includes:

a revolver member including a plurality of beds each configured to hold a respective one of the submersible objects; and a drive mechanism to rotate the revolver member to selectively position each of the beds adjacent the staging location; and the singulator dispenser includes:

a hopper configured to hold a stack of the submersible objects; and a singulator configured to receive and controllably convey at least one of the submersible objects from the hopper to the staging location; and selectively operating the deployment system to controllably release at least one of the plurality of submersible objects from the hold into submersion in the body of liquid and/or selectively operating the deployment system to controllably direct at least one of the plurality of submersible objects into the hold from submersion in the body of liquid, including selectively extending the guide members of a guide to engage and direct the at least one submersible object, and including operating the revolver dispenser or the singulator dispenser to move the at least one of the plurality of submersible objects;

wherein, when the guide members are extended, the guide members are configured to manage a flow of the liquid with respect to the platform and the at least one submersible object.

17. The method of claim 16 wherein the guide members are elongated tines.

18. The method of claim 16 including operating the deployment system to recover one of the submersible objects from submersion in the body of liquid into the hold.

19. The method of claim 16 including guiding the at least one submersible object into the hold using the guide members.

20. The method of claim 16 wherein the submersible objects are unmanned underwater vehicles (UUVs).

21. The method of claim 16 wherein the submersible objects are sensors.

22. The method of claim 16 wherein the SOM system includes a connector, wherein:

the hold and the connector are mounted on the platform; and the method includes coupling the connector with at least one of the submersible objects and transferring power and/or communicating signals between the submersible object and the platform via the connector.

23. The method of claim 16 wherein the platform is a mobile platform, and the hold and the deployment system are mounted on the mobile platform.

24. The SOM system of claim 14 wherein the guide members, when extended, are configured to breakup, reduce, redirect or dissipate turbulence in the flow of the liquid with respect to the platform and the at least one submersible object to thereby smooth exit of the at least submersible object from the hold into submersion in the body of liquid and/or to thereby smooth entry of the at least one submersible object into the hold from submersion in the body of liquid.

25. The SOM system of claim 2 wherein the tines, when extended, define gaps between adjacent ones of the tines and through which the liquid can flow.

26. The method of claim 16 wherein the guide members, when extended, are configured to breakup, reduce, redirect or dissipate turbulence in the flow of the liquid with respect to the platform and the at least one submersible object to thereby smooth exit of the at least submersible object from the hold into submersion in the body of liquid and/or to thereby smooth entry of the at least one submersible object into the hold from submersion in the body of liquid.

27. The method of claim 17 wherein the tines, when extended, define gaps between adjacent ones of the tines and through which the liquid can flow.

28. The method of claim 23 including moving the mobile platform through the body of liquid and thereby providing the flow of the liquid with respect to the platform and the at least one submersible object.

29. A submersible object management (SOM) system for releasing and/or recovering a plurality of submersible objects within a body of liquid, the SOM system comprising:

a hold for storing the plurality of submersible objects; and a deployment system selectively operable to controllably release at least one of the plurality of submersible objects from the hold into submersion in the body of liquid and/or selectively operable to controllably direct at least one of the plurality of submersible objects into the hold from submersion in the body of liquid, wherein the deployment system includes:

a guide that is selectively extendable to direct the at least one submersible object, the guide including a plurality of extendable guide members configured to engage the at least one submersible object; and a dispenser being configured to convey at least one of the submersible objects between the hold and a staging location, wherein the dispenser includes:

a hopper configured to hold a stack of the submersible objects; and a singulator configured to receive and controllably convey at least one of the submersible objects from the hopper to the staging location.

* * * * *

UNITED STATES PATENT AND TRADEMARK OFFICE

CERTIFICATE OF CORRECTION

PATENT NO. : 8,336,479 B2
APPLICATION NO. : 12/355966
DATED : December 25, 2012
INVENTOR(S) : Vosburgh et al.

It is certified that error appears in the above-identified patent and that said Letters Patent is hereby corrected as shown below:

In the Claims:

Column 9, Claim 11, Line 57: Please correct "including is a mobile"
to read -- including a mobile --

Signed and Sealed this
Twenty-eighth Day of May, 2013

Teresa Stanek Rea
*Acting Director of the United States Patent and Trademark Office*